US008096449B2

(12) United States Patent
Keller

(10) Patent No.: US 8,096,449 B2
(45) Date of Patent: Jan. 17, 2012

(54) DISPENSING APPLIANCE FOR A MULTIPLE CARTRIDGE

(75) Inventor: Wilhelm A. Keller, Merlischachen (CH)

(73) Assignee: Medmix Systems AG, Rotkreuz (CH)

( * ) Notice: Subject to any disclaimer, the term of this patent is extended or adjusted under 35 U.S.C. 154(b) by 469 days.

(21) Appl. No.: 12/309,352

(22) PCT Filed: Jun. 7, 2007

(86) PCT No.: PCT/CH2007/000330

§ 371 (c)(1),
(2), (4) Date: Jan. 15, 2009

(87) PCT Pub. No.: WO2008/009143

PCT Pub. Date: Jan. 24, 2008

(65) Prior Publication Data

US 2009/0302060 A1 Dec. 10, 2009

(30) Foreign Application Priority Data

Jul. 17, 2006 (CH) ..... 1148/06

(51) Int. Cl.
*B67D 7/70* (2010.01)

(52) U.S. Cl. ..... 222/137; 222/390; 604/232

(58) Field of Classification Search ..... 222/137–142, 222/390, 135, 136, 325–327, 145.1, 145.5, 222/145.6; 604/232, 82

See application file for complete search history.

(56) References Cited

U.S. PATENT DOCUMENTS

| | | | | |
|---|---|---|---|---|
| 1,569,268 | A | 1/1926 | Dupre | |
| 3,166,221 | A | 1/1965 | Nielsen | |
| 3,952,920 | A | 4/1976 | Bergman | |
| 4,623,337 | A | 11/1986 | Maurice | |
| 4,968,299 | A * | 11/1990 | Ahlstrand et al. | 604/90 |
| 5,535,922 | A | 7/1996 | Maziarz | |
| 6,565,539 | B1 * | 5/2003 | Zinger et al. | 604/191 |
| 2002/0166878 | A1 | 11/2002 | Mizutani et al. | |
| 2003/0089743 | A1 | 5/2003 | Py et al. | |
| 2004/0216591 | A1 | 11/2004 | Assadi et al. | |

FOREIGN PATENT DOCUMENTS

| | | |
|---|---|---|
| DE | 101 28 611 | 12/2002 |
| EP | 0 621 083 | 10/1994 |
| EP | 0 941 940 | 9/1999 |
| FR | 1 179 121 | 5/1959 |
| WO | WO-2004/067962 | 8/2004 |

* cited by examiner

*Primary Examiner* — Lien Ngo
(74) *Attorney, Agent, or Firm* — Foley & Lardner LLP

(57) ABSTRACT

The dispensing appliance for a multiple cartridge or syringe comprising a housing configured to receive the cartridge that has an internal thread and a rotatable portion that has a complementary thread, the internal thread and the rotatable portion cooperating in such a manner that by mutual rotation thereof, the rotatable portion is continuously displaceable relative to the housing in the dispensing direction. The housing is configured to receive the cartridge that has two adjacent storage containers, and a thrust force of the rotatable portion is transmitted to a multiple ram without any pressure relief. This arrangement allows dispensing even highly viscous materials from cartridges with little manual force under high pressure and in a precisely metered manner.

9 Claims, 2 Drawing Sheets

DISPENSING APPLIANCE FOR A MULTIPLE CARTRIDGE

Figures 1, 2:
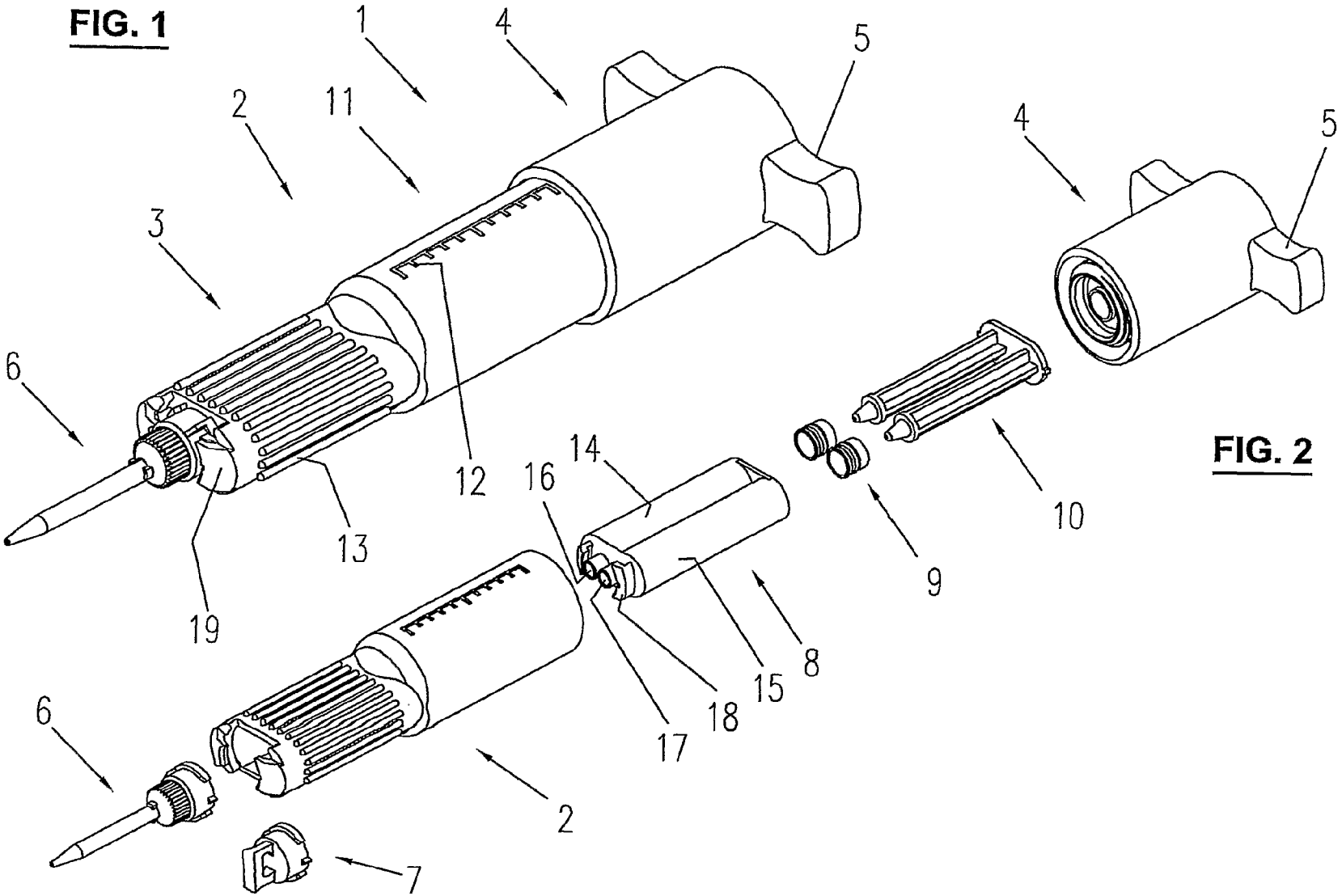

This application is the National Phase of PCT/CH2007/000330, filed Jul. 6, 2007, which claims priority to Switzerland Application No. 01148/06, filed Jul. 17, 2006. The contents of the foregoing applications are incorporated by reference in their entirety.

The present invention relates to a dispensing appliance for a multiple cartridge, comprising a housing for receiving the cartridge that has a thread and a rotatable portion that has a complementary thread, according to the preamble of claim 1.

A dispensing appliance of this kind is known from DE-101 28 611 A1, the appliance having two concentrically arranged storage containers and the rotatable portion comprising a ram with an inner and an outer ram part, the outer ram part being provided with the thread.

CH-322 201 also discloses a dispensing appliance where the storage containers are arranged concentrically and one of the rods of the dispensing pistons is provided with a threaded portion that cooperates with a corresponding threaded portion in the center of the inner storage cylinder.

There exist further a wealth of dispensers where one part of the housing rotates in relation to another part for extruding pharmaceutical and the like materials, such as US 2003/0089743 A1, US 22002/0166878 A1, DE 101 28 611 A1, and U.S. Pat. No. 4,623,337. However, all those prior art documents disclose a single component cartridge or syringe, where the problem adressed is much simpler.

Another category are the dispensers with a threaded dispensing movement and two adjacent storage cylinders which are disclosed in U.S. Pat. No. 3,952,920 and EP 0 621 083 A1, where a central threaded bar bears on rams. This solutions are not adapted for medical use and are very difficult to sterilize.

Furthermore, manually operated dispensing appliances for a double cartridge for dispensing two-component materials are available on the market which are designed in the manner of a gun, for example U.S. Pat. No. 5,535,922. During the return movement of the lever transmission mechanism, the double ram is relieved and a total pressure relief of the cartridge is caused, thereby interrupting the material flow. An accurately metered application as it is advantageous particularly in the application of bone cements is thus impossible. Furthermore, in the case of highly viscous materials, limits are imposed on such appliances by the fact that either a high multiplication ratio is required and thus a complicated mechanism, or high forces have to be applied.

On the background of this prior art, it is an object of the present invention to provide a screw feed dispensing appliance that is suitable for multiple cartridges or multiple syringes having at least two adjacent storage containers, whose construction is simple, that allows even highly viscous materials to be dispensed with a relatively low manual force expenditure, and is suitable for medical applications.

The invention will be explained in more detail hereinafter with reference to drawings of an exemplary embodiment.

Figure 3:
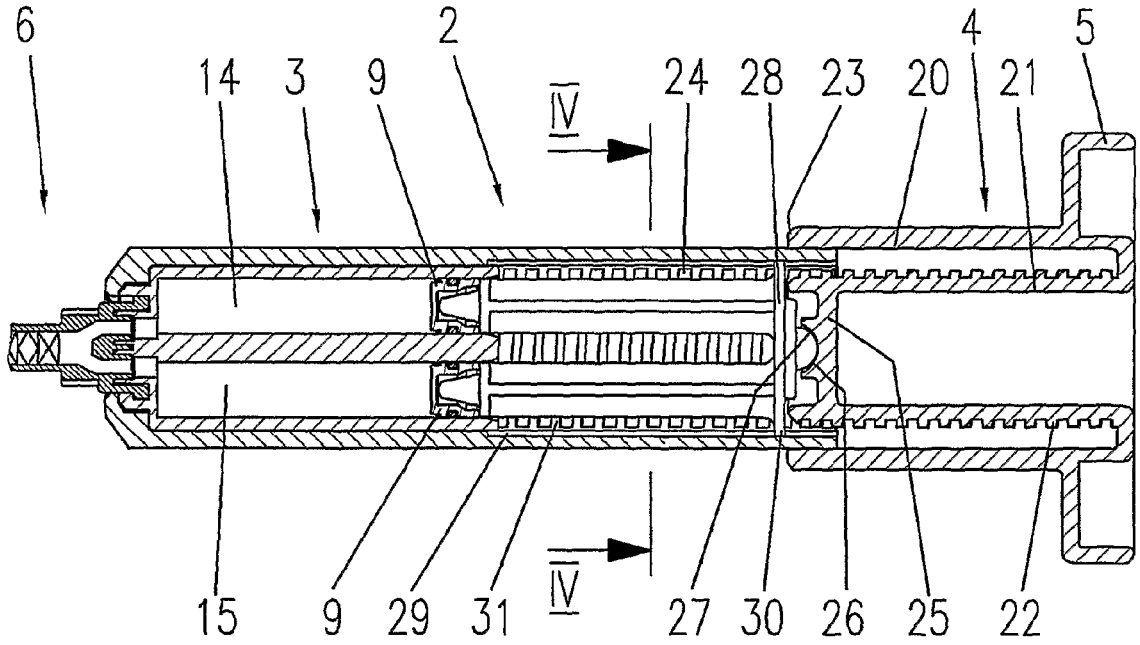
Figure 4:
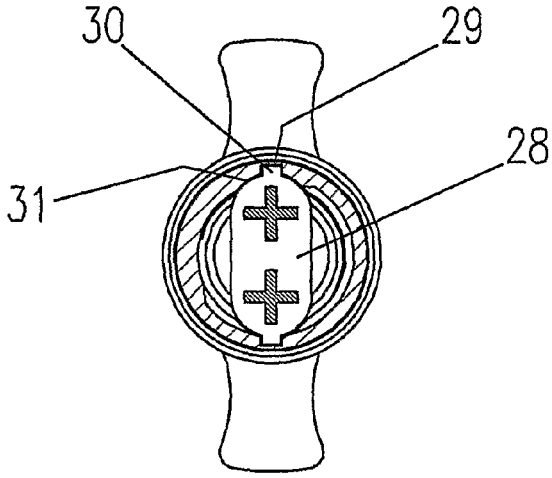

FIG. 1 shows a perspective view of the dispensing appliance according to the invention, FIG. 2 shows an exploded view of the dispensing appliance of FIG. 1 as well as the individual elements of a double cartridge, FIG. 3 shows a longitudinal section of the appliance of FIG. 1, and FIG. 4 shows a section according to line IV-IV in FIG. 3.

As appears in the drawings, the principle of the dispensing appliance according to the invention is based on mutual interpenetration of two parts that are rotated with respect to one another, whereby a continuous and accurately metered feed can be achieved. Hereinafter, the term "double cartridge" in the exemplary embodiment stands for a multiple cartridge or syringe. In this regard, it is apparent to one skilled in the art that in the case of more than two storage containers, a corresponding number of pistons and rams will have to be provided.

FIG. 1 shows dispensing appliance 1 with housing 2 and gripping area 3 thereof as well as a rotatable portion 4 provided with rotary lobe 5. These parts are also found in FIG. 2, where a conventional mixer 6 and a conventional closure cap 7 are shown at the dispensing end. Between housing 2 and rotatable portion 4, a double cartridge 8 with pistons 9 and double ram 10 is arranged.

Furthermore, in FIGS. 1 and 2, a graduation 12 is applied on housing section 11 on the inlet side of housing 2 and ridges 13 are provided on gripping area 3 of housing 2 in order to ensure a rotationally secure grip.

Cartridge 8 has two adjacent storage cylinders 14 and 15 having each the same diameter. However, the storage cylinders can also have different diameters or volumes, respectively. The cartridge further comprises two outlets 16 and 17 as well as bayonet sockets 18. As appears in FIGS. 1 and 3, bayonet sockets 18 come to rest on correspondingly shaped bayonet reinforcement members 19 on the gripping area of housing 2.

In FIG. 3 it is apparent that rotatable portion 4 is essentially composed of an internal cylinder 21 having an external thread 22 and of a cylindrical outer sleeve 20. End portion 23 on the outlet side of sleeve 20 serves as an indicator edge that cooperates with graduation 12 on housing 2 for indicating the dispensed volume.

In FIG. 3 it is further visible that housing section 11 of housing 2 is provided with an internal thread 24 that cooperates with external thread 22 on internal cylinder 21 of the rotatable portion. The force transmission from the rotatable portion to the double ram is achieved by a bearing 25 on the dispensing side of rotatable portion 4 that has a centrally arranged, spherically shaped bearing surface 26 which cooperates with a corresponding spherically shaped bearing surface 27 in the center of thrust plate 28 of double ram 10. This arrangement ensures that only a small torque is transmitted to the thrust plate. This torque is absorbed by two guiding grooves 29 in housing section 11, see FIG. 4, in which two corresponding cams 30 on thrust plate 28 are guided. In order to allow the displacement of thrust plate 28, the internal thread has two opposed passages in the form of grooves 31.

In FIG. 3, the elements of FIG. 2 are shown while the appliance is ready for dispensing. The force transmission by a thread allows dispensing highly viscous materials without a great force expenditure and mainly also avoiding a complete pressure relief of the rams and thus an interruption of the material flow.

The invention claimed is:

1. A dispensing appliance for a multiple cartridge or syringe, comprising:

a housing configured to receive the multiple cartridge or syringe, and wherein the housing has a housing thread and a rotatable portion that has a complementary thread, wherein the housing thread and the rotatable portion cooperate in such a manner that by a mutual rotation of the housing thread and the rotatable portion, the rotatable portion is continuously displaceable relative to the housing in a dispensing direction, wherein the housing is configured to receive the multiple cartridge or syringe having at least two adjacent and parallel storage containers, wherein a thrust force of the rotatable portion is transmitted to a multiple ram with a single thrust plate, and wherein the multiple ram slides in the at least two adjacent and parallel storage containers of the multiple cartridge or syringe and the thrust plate is non-rotatably guided inside the housing.

2. The dispensing appliance of claim 1, wherein the rotatable portion comprises an external sleeve and an internal cylinder having the complementary thread, wherein the complementary thread cooperates with the housing thread, and wherein the complementary thread comprises an external thread and the housing thread comprises an internal thread.

3. The dispensing appliance of claim 1, wherein the rotatable portion is provided on its outlet side with a centrally arranged bearing acting upon the thrust plate of the multiple ram.

4. A dispensing appliance for a multiple cartridge or syringe, comprising:

a housing configured to receive the multiple cartridge or syringe, and wherein the housing has a housing thread and a rotatable portion that has a complementary thread, wherein the housing thread and the rotatable portion cooperate in such a manner that by a mutual rotation of the housing thread and the rotatable portion, the rotatable portion is continuously displaceable relative to the housing in a dispensing direction, wherein the housing is configured to receive the multiple cartridge or syringe having at least two adjacent storage containers, wherein a thrust force of the rotatable portion is transmitted to a multiple ram sliding in the at least two adjacent storage containers of the multiple cartridge or syringe, wherein the rotatable portion is provided on its outlet side with a centrally arranged bearing acting upon a thrust plate of the multiple ram, and wherein the centrally arranged bearing on the rotatable portion comprises a spherically shaped bearing surface and wherein the spherically shaped bearing surface corresponds to a correspondingly spherically shaped bearing surface on the thrust plate.

5. A dispensing appliance for a multiple cartridge or syringe, comprising:

a housing configured to receive the multiple cartridge or syringe, and wherein the housing has a housing thread and a rotatable portion that has a complementary thread, wherein the housing thread and the rotatable portion cooperate in such a manner that by a mutual rotation of the housing thread and the rotatable portion, the rotatable portion is continuously displaceable relative to the housing in a dispensing direction, wherein the housing is configured to receive the multiple cartridge or syringe having at least two adjacent storage containers, wherein a thrust force of the rotatable portion is transmitted to a multiple ram sliding in the at least two adjacent storage containers of the multiple cartridge or syringe, wherein the rotatable portion is provided on its outlet side with a centrally arranged bearing acting upon a thrust plate of the multiple ram, and wherein the thrust plate has two cams and wherein the two cams are guided in respective guiding grooves inside the housing.

6. A dispensing appliance for a multiple cartridge or syringe, comprising:

a housing configured to receive the multiple cartridge or syringe, and wherein the housing has a housing thread and a rotatable portion that has a complementary thread, wherein the housing thread and the rotatable portion cooperate in such a manner that by a mutual rotation of the housing thread and the rotatable portion, the rotatable portion is continuously displaceable relative to the housing in a dispensing direction, wherein the housing is configured to receive the multiple cartridge or syringe having at least two adjacent storage containers, wherein a thrust force of the rotatable portion is transmitted to a multiple ram sliding in the at least two adjacent storage containers of the multiple cartridge or syringe, and wherein the multiple cartridge or syringe is provided at its outlet end with bayonet slots and wherein the bayonet slots come to rest on bayonet reinforcement members at the outlet end of the housing.

7. A dispensing appliance for a multiple cartridge or syringe, comprising:

a housing configured to receive the multiple cartridge or syringe, and wherein the housing has a housing thread and a rotatable portion that has a complementary thread, wherein the housing thread and the rotatable portion cooperate in such a manner that by a mutual rotation of the housing thread and the rotatable portion, the rotatable portion is continuously displaceable relative to the housing in a dispensing direction, wherein the housing is configured to receive the multiple cartridge or syringe having at least two adjacent storage containers, wherein a thrust force of the rotatable portion is transmitted to a multiple ram sliding in the at least two adjacent storage containers of the multiple cartridge or syringe, and wherein the housing of the multiple cartridge or syringe further comprises a graduation and wherein the graduation cooperates with a front edge of a sleeve of the rotatable portion in order to indicate a dispensed volume.

8. The dispensing appliance of claim 4, wherein the rotatable portion comprises an external sleeve and an internal cylinder having the complementary thread, wherein the complementary thread cooperates with the housing thread, and wherein the complementary thread comprises an external thread and the housing thread comprises an internal thread.

9. The dispensing appliance of claim 4, wherein the thrust plate is non-rotatably guided inside the housing.

* * * * *

UNITED STATES PATENT AND TRADEMARK OFFICE

CERTIFICATE OF CORRECTION

PATENT NO. : 8,096,449 B2
APPLICATION NO. : 12/309352
DATED : January 17, 2012
INVENTOR(S) : Wilhelm A. Keller It is certified that error appears in the above-identified patent and that said Letters Patent is hereby corrected as shown below:

On the Front of the Patent:

At line (22) please delete the date "Jun. 7, 2007" and replace with -- July 6, 2007 --

Signed and Sealed this
First Day of May, 2012

David J. Kappos

David J. Kappos
*Director of the United States Patent and Trademark Office*